US006219848B1

(12) United States Patent
Russell

(10) Patent No.: US 6,219,848 B1
(45) Date of Patent: Apr. 24, 2001

(54) WAISTBAND EXTENDER

(76) Inventor: Vivian F. Russell, 4112 Arborway, Charlotte, NC (US) 28211

( * ) Notice: Subject to any disclaimer, the term of this patent is extended or adjusted under 35 U.S.C. 154(b) by 0 days.

(21) Appl. No.: 09/507,604

(22) Filed: Feb. 21, 2000

(51) Int. Cl.[7] ..... A41D 1/14
(52) U.S. Cl. ..... 2/221; 2/237
(58) Field of Search ..... 2/237, 221, 215, 2/234, 219, 220, 227, 236, 76, 79, 338, 141.1, 311–312, 336

(56) References Cited

U.S. PATENT DOCUMENTS

| | | | | |
|---|---|---|---|---|
| 1,861,383 | * | 5/1932 | Ficcio | 2/237 |
| 2,606,322 | | 8/1952 | Vraciu . | |
| 2,747,197 | | 5/1956 | Bailey . | |
| 2,873,452 | | 2/1959 | Jacobs . | |
| 3,431,562 | | 3/1969 | Souders . | |
| 3,806,953 | * | 4/1974 | Kalil | 2/227 |
| 4,580,298 | | 4/1986 | Tuisl . | |
| 4,803,740 | | 2/1989 | Dawson . | |
| 5,163,184 | | 11/1992 | Reardon . | |
| 5,575,011 | | 11/1996 | Allen . | |

* cited by examiner

*Primary Examiner*—John J. Calvert
*Assistant Examiner*—Tejash Patel
(74) *Attorney, Agent, or Firm*—Alston & Bird, LLP

(57) ABSTRACT

A waistband extender having a modesty panel covering the outside of the garment and having a generally inverted triangular shape with a button and buttonhole waistband securer that cooperates with the button and buttonhole fastener on the garment, a belt loop securer, and at least one zipper stop for maintaining the zipper in an open position. In preferred embodiments of the invention, the upper edge is elasticized and the modesty panel is made from a material that is similar in appearance to or complements the garment fabric.

13 Claims, 4 Drawing Sheets

WAISTBAND EXTENDER

FIELD OF THE INVENTION

The present invention is directed to waistband extenders for wearing apparel having an opening waistband secured by a fastener. The present invention is further directed to adjustable waistband extenders that can be used to accommodate changing girths, as in pregnancy or weight changes, while providing modesty to the wearer.

BACKGROUND OF THE INVENTION

In the wearing apparel field, a wide variety of clothing is designed so that the portion encircling the wearer's waist fits snugly. In articles such as jeans, skirts, trousers and the like, where the article of clothing reaches up to and terminates about the waist, the waist encircling portion is generally provided with means for drawing such portion from a loose to a close fit and securing same.

When reasonably close waist line fit is desired in a garment, difficulties arise due to body dimension variations, both from person to person in the general population, and for a given person temporary changes in their girth. In particular, during early term pregnancies, the girth has increased so that the wearing apparel does not readily fasten, but is insufficient to justify the expenditure oh maternity clothing. One often either sacrifices close fit or comfort.

Various adjustable features for waist lines have been previously devised. For instance, garments have been made with permanently joined waistbands of excess girth, which are gathered to smaller dimensions by elastic material encased within the waistband. Such "continuously" adjustable waistbands, however, are often deemed unsuitable due to their gathered appearance.

Previous efforts to deal with this have included making permanent modifications to the garment by adding gores or extra material and thus increasing the size of the garment in the waistband area.

Removable waistband adjusting means have left a gap in the fly opening of the garment often exposing the skin of the wearer and thus rending the expanded garment distasteful to the observer.

All of these adjusting means require additional elements to be incorporated into the garment at manufacture or alterations to the garment after manufacture, and in many instances the stylish appearance of a garment as to the area around the waistband is lost due to these additional elements and/or alterations.

For many wearers, a means for occasionally and temporarily adjusting a "styled to fit" garment in order to loosen the waistband is desired. Such a means, if adaptable to any conventional means for closing waistbands, would permit practically unlimited choice as to purchasing jeans, skirts, trousers and the like in a size providing the desired fit, which then may occasionally be adjusted to loosen the fit for comfort when required. It is further desired that such means require no permanent alteration to the garment itself so as to retain its normal stylish appearance when the need for waistband loosening passes.

For some wearers, a means for loosening the waistband of ready-to-wear clothing is necessary generally due to size problems. For such wearers, it is often desired that such a loosening means be relatively inexpensive and avoid costly alterations. Again, if such means be adaptable to any conventional means for closing waistbands, the choice in clothing selection becomes almost unlimited. Further if the means is detachable, one can avoid purchasing such separate means for each and every garment requiring same.

It is an object of the present invention to provide a means for extending the waistband of a garment with normal closure means. It is an object to provide such means which can be used as a temporary measure and requires no alteration of the garment itself. It is an object to provide such means which, in use, permits security of closing. These and other objects will become apparent from the description of the invention given below.

It is further object of the present invention to provide a simple and convenient means for adapting a lower body garment for use during the early stages of pregnancy and, thereafter, a method permitting the garment to be returned to its original form and appearance without alteration.

SUMMARY OF THE INVENTION

The present invention is directed to a waistband extender for wearing apparel which may be removably secured to the waistband of the wearing apparel when extra room in the abdominal area of the wearer is needed. This device is particularly useful for women during early term pregnancy when maternity clothes arc too large to be worn but yet regular wearing apparel with waistbands are too small. The waistband extender covers the opening in the garment and thus provides modesty to the wearer.

The waistband extender is made of a flexible fabric material in the form of a generally inverted triangular shape panel with an upper edge which, when worn, is positioned adjacent the waistband of the wearing apparel. Preferably, this upper edge is elasticized. The fabric material extends downward from the upper edge and tapers as it extends towards a bottom edge. The flexible fabric material is preferably a color and/or design complimenting the material forming the wearing apparel.

Several features are provided to secure the waistband extender to the wearing apparel. First, a waistband securer is used to secure the upper edge of a modesty panel to the waistband of the garment. The waistband securer comprises a button provided along the inner surface of the elasticized upper edge of the fabric material adjacent one of its side edges and a buttonhole adjacent the opposite side edge. In use, the button of the waistband securer mates with the buttonhole on the waistband of the wearing apparel while the button on the waistband of the wearing apparel cooperates with the buttonhole of the waistband securer.

In a further embodiment, a belt loop securer extends outwardly from each corner of the upper edge of the fabric material. The belt loop securer is defined by an elongate strip of fabric which loops through the belt loop of the slacks and folds upon itself and is fastened into place thereby further securing the waistband extender to the wearing apparel by also connecting it to the belt loops of the wearing apparel.

At least one zipper stop is provided on the waistband extender and is positioned beneath the elasticized upper edge. The zipper stop or zipper stops are positioned at various locations along the vertical length of the waistband extender. The zipper stops are defined by a button and an elasticized loop extending therefrom. The elasticized loop is threaded through the eye of the conventional zipper on the slacks and is folded back onto itself and secured by mating with the button of the zipper attachment. In a preferred embodiment of the present invention, a plurality of the zipper attachments are provided on the modesty panel to accommodate different persons and different sizes during early term pregnancies.

BRIEF DESCRIPTION OF THE DRAWINGS

The above objects and further features and advantages of the invention are described in detail below in conjunction with the drawings, of which.

DETAILED DESCRIPTION OF THE INVENTION

Figure 1:
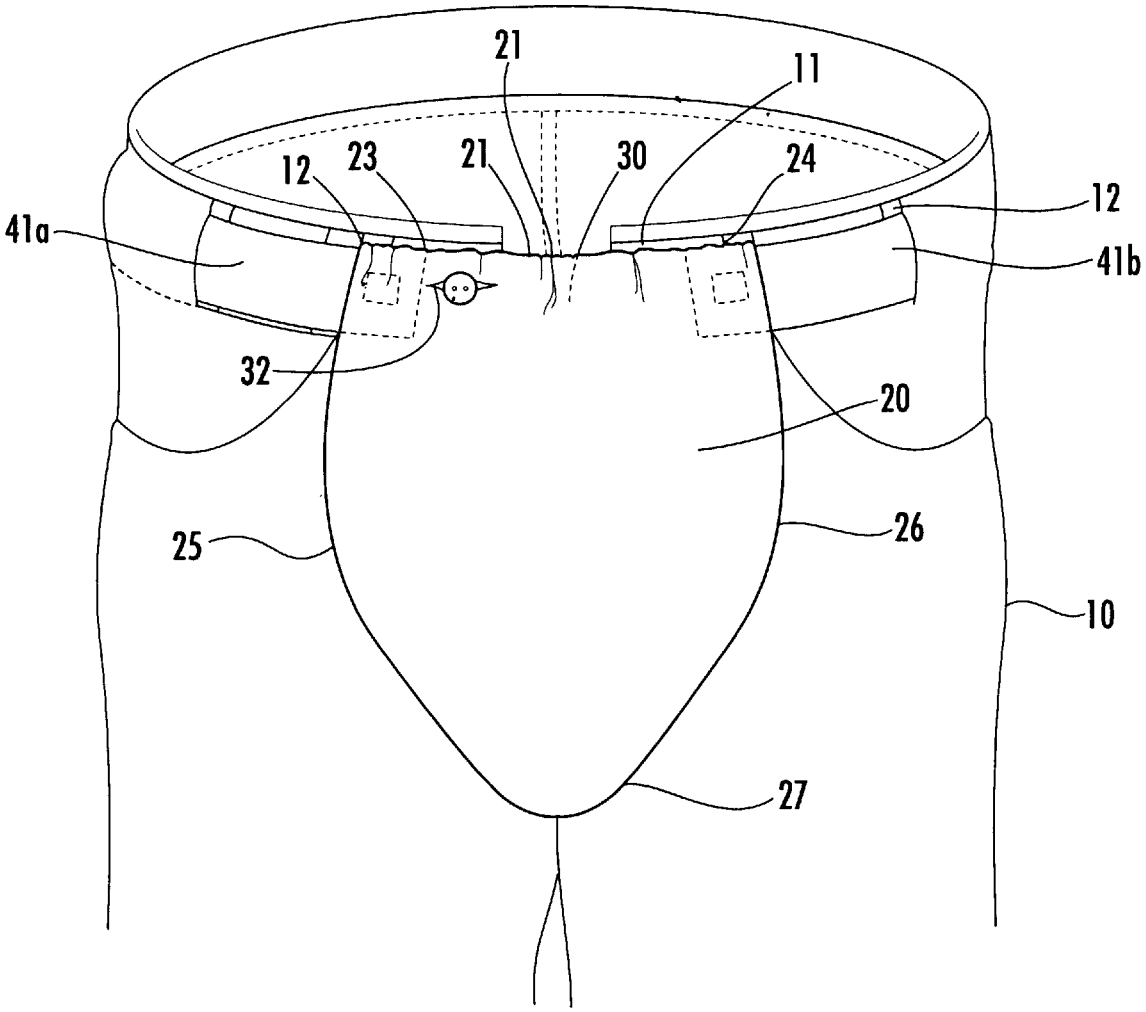
FIG. 1 is a perspective view of the waistband extender of the present invention shown in use with a pair of pants with the modesty panel covering the extended opening.

As shown in FIG. 1, the present invention is directed to a waistband extender 15 that increases the size of the waistband 11 of a lower body garment 10 while still providing modesty to the wearer by covering the extended opening.

Figure 2:
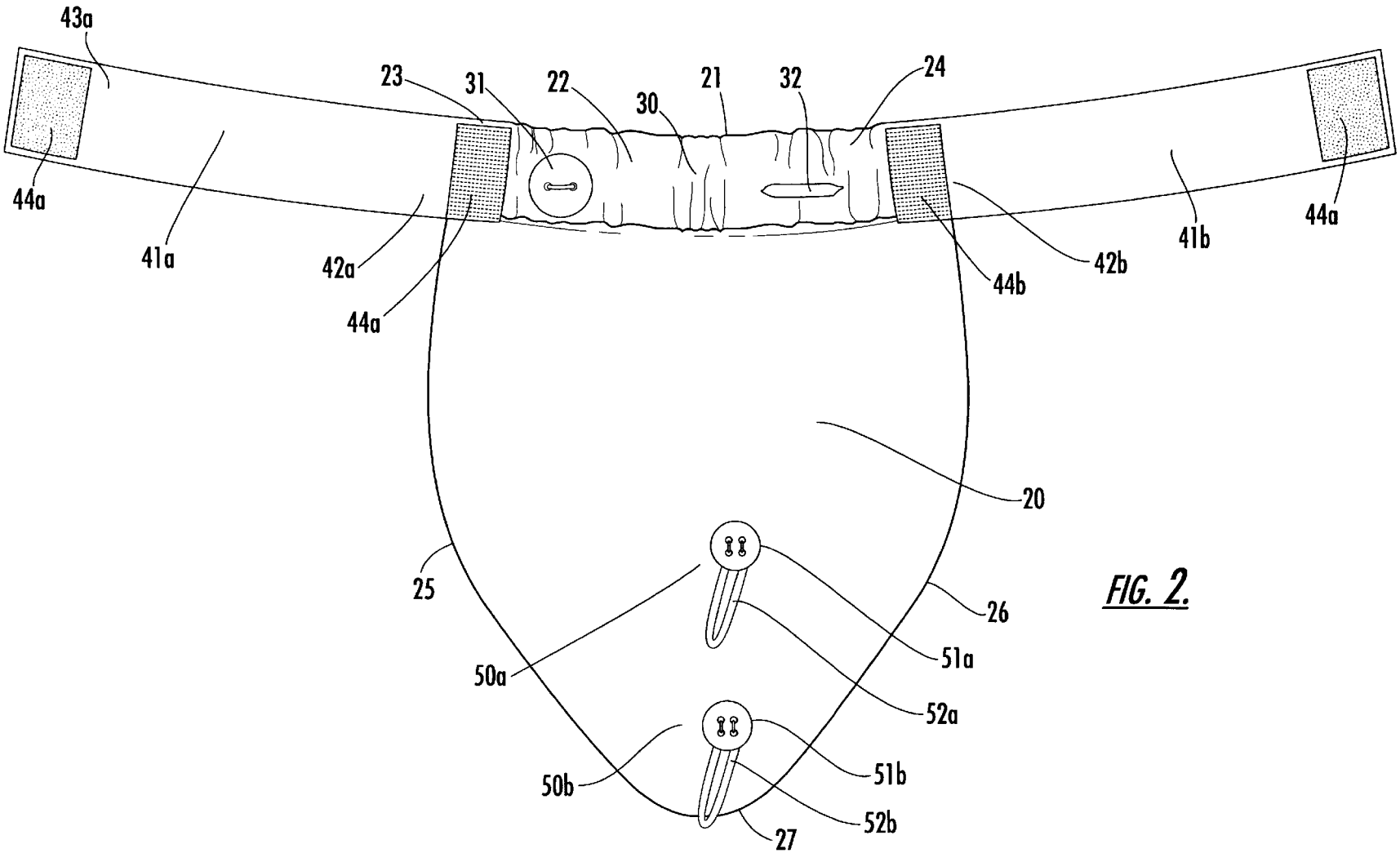
FIG. 2 is a schematic view of the waistband extender shown with the belt loop securer in the open position.
Figure 3:
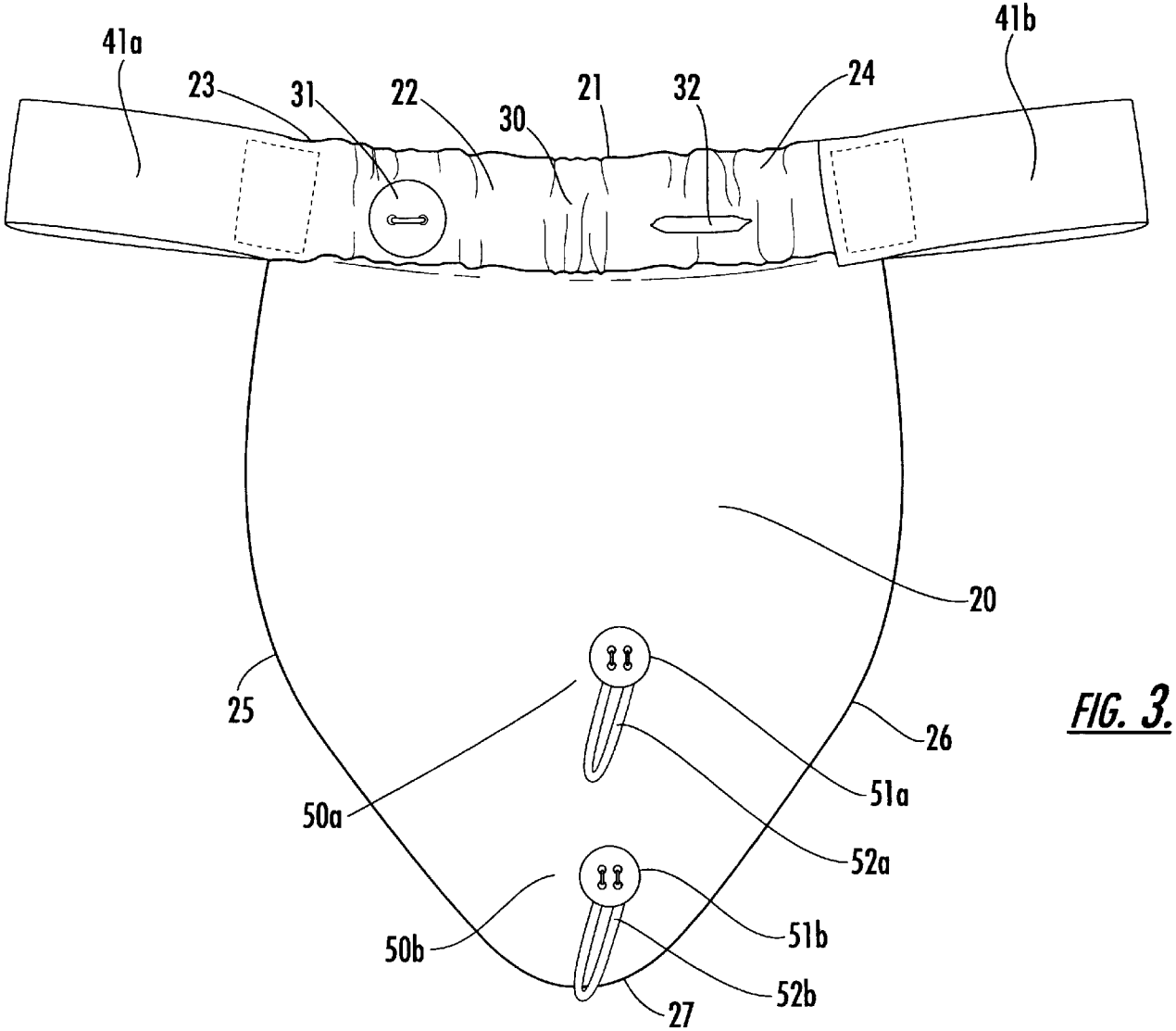
FIG. 3 is a schematic view of the waistband extender with the belt loop securer in the closed position.
Figure 4:
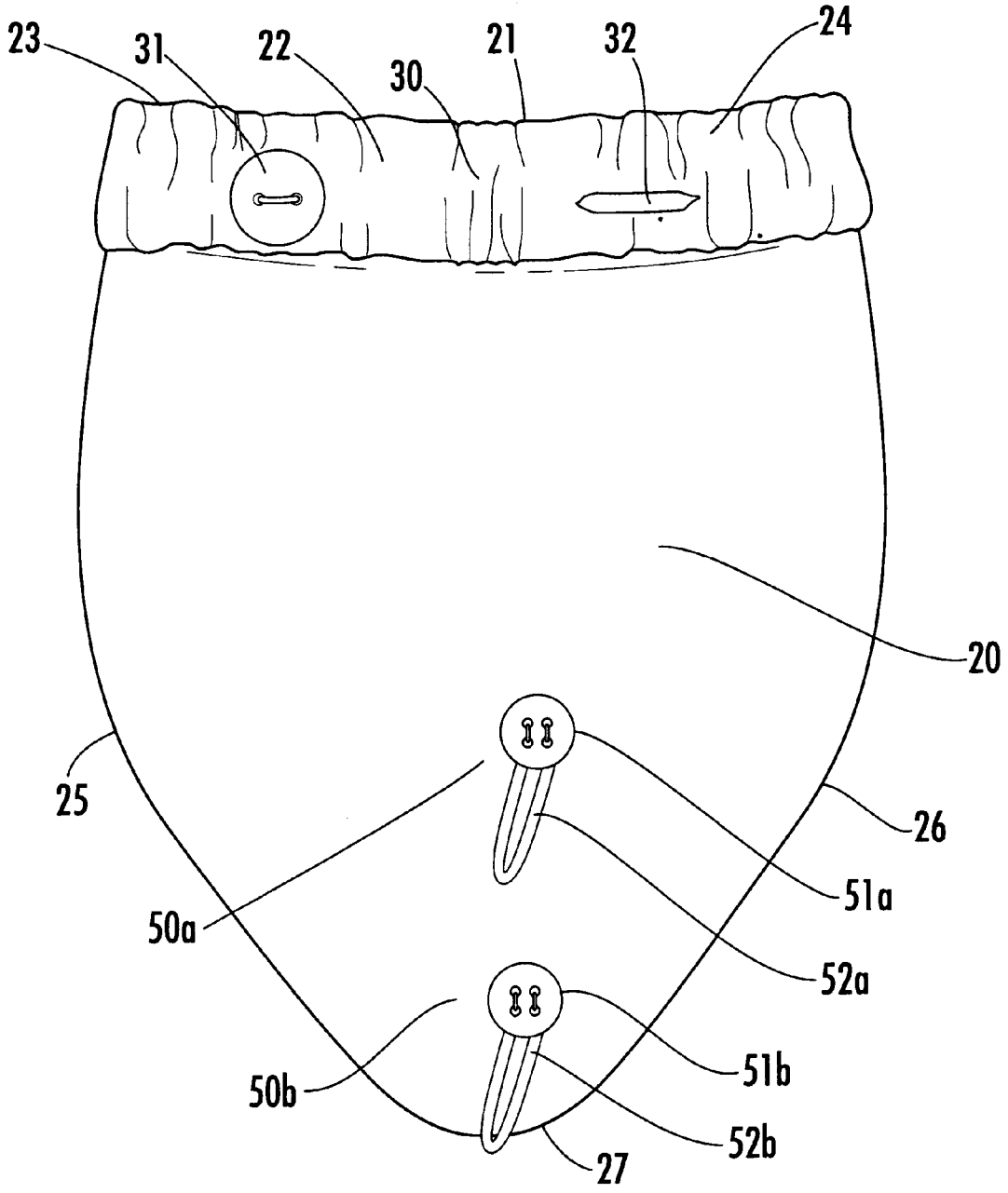
FIG. 4 is a schematic view of an alternative embodiment of the present invention.

As shown in FIGS. 2 and 3, the waistband extender comprises a modesty panel 20 having a generally triangular inverted shape with an upper edge 21 and two tapered sides 25 and 26 that meet at a tapered point 27. As depicted in FIG. 1, the upper edge 21 of modesty panel 20 is positioned adjacent to the wearer's waist and is secured so that the upper edge 21 operates to enlarge the waistband 11 of the lower body garment 10.

The upper edge 21 and the tapered sides are finished in any suitable manner and will depend upon the material used in the modesty panel. For example, they can be finished with a hem, an overcast stitching, pinking, a stay seam, binding, or simply left unfinished for those materials such as felt or Ultrasuede™ that are not susceptible to unraveling. In a preferred embodiment of the invention, the tapered side edges 25 and 26 are tapered so that the modesty panel 20 lies flat when secured in place to the lower body garment 10.

In a preferred embodiment of the present invention the upper edge 21 has an elastic portion 22. The elastic portion 22 may be created by any suitable means known to one of ordinary skill in the art including forming a casing to hold the elastic or stitching or adhering the elastic directly to the upper edge 21.

The modesty panel 20 can be made of any suitable flexible material and in a preferred embodiment of the present invention is made of a fabric similar in appearance to or complementing the fabric used to construct the lower body garment 10. The modesty panel 20 fabric may be similar in color, texture, design, fabric type, and the like.

The waistband extender 15 is secured in place in several different ways. A waistband securer 30 cooperates with the fastener on the waistband 11 of lower body garment 10. A zipper stop 50*a* is used to secure the lower portion of the modesty panel to the zipper so that the zipper is maintained in its opened position and does not inadvertently open further. Additional security is provided in an alternate embodiment by belt loop securers 40.

The waistband securer 30 is located on the inside portion of the upper edge 21 of the modesty panel 20. The waistband securer 30 comprises a button 31 located at a first end 23 of the upper edge 21 and a buttonhole 32 located at a second end 24 of the upper edge 21. The button 31 is buttoned into the buttonhole on waistband 11 of the lower body garment 10. The buttonhole 32 has the button on the waistband 11 buttoned into it. This operates to extend the size of the waistband 11 of the lower body garment 10 by the distance between the button 31 and the buttonhole 32. The waistband securer 30 is fastened so that the inside portion of the modesty panel 20 faces the inside of the lower body garment 10 and the outside of the modesty panel 20 covers the opening created and provides modesty to the wearer.

At least one zipper stop, and preferably a plurality of zipper stops, is located along the inside midline 28 of the modesty panel 20 between the upper edge 21 and the tapered point 27. Each zipper stop 50 comprises a button 51 and a loop 52. The ends of the loop 52 are secured at or under the button 51. The loop 52 is threaded through the eye of the zipper tab and is then looped or buttoned around the button 51. This secures the zipper in place and prevents it from opening further, thus averting possible distress to the wearer. In a preferred embodiment of the invention, there are a plurality of zipper stops, such as 50*a* and 50*b* shown in FIG. 3, so that the wearer can select the extent that the zipper will be open. With a smaller girth, the zipper can be maintained in a more closed position and thus the upper zipper stop 50*a* can be used. As the girth of the wearer increases, the zipper can be maintained in a more open position, thus providing more comfort to the wearer, and a lower zipper stop such as 50*b* can be utilized.

In a further embodiment of the invention, additional security is provided by the use of belt loop securers 40*a* and 40*b*. FIG. 2 depicts the belt loop securers 41*a* and 41*b* in the open position and FIG. 3 depicts them in the closed position. Each of the belt loop securers comprises a strap 41 with a fastener 44 at each end of the strap 41. The strap 41 is attached at one end 42 to one of the ends 23 or 24 of the upper edge 21 of modesty panel 20. As shown in FIG. 1, the free end 43 of the strap 41 is threaded through a belt loop on the lower body garment 10 and is then looped back onto the fastener 44. Tile fastener 44 can be any suitable fastener known to one of ordinary skill in the art. In one embodiment, the fastener 44 is of the hoop and loop type, i.e. Velcro™. Other suitable fasteners include snaps, hook and eyes, and the like.

It should be understood that the embodiments described herein are merely exemplary and that a person skilled in the art may make variations and modifications without departing from the spirit and scope of the invention. For example, the snap fasteners, button fasteners and hook and loop (i.e., Velcro™) fasteners of any described embodiment are interchangeable among the embodiments. Similarly, any other known material fastening device can be substituted. Although all described embodiments relate to pants, it should be understood that the present invention can be used with any garment, such as shorts, skirts or the like that are fastened around the waist, and the closeable seam of such garments need not be formed on the front of the garment. All such variations and modifications are intended to be included within the scope of the invention as defined in the appended claims.

What is claimed is:

1. A detachable waistband extender for removably extending the girth of a waistband in a lower body garment:

a readily detachable modesty panel covering an extended opening on the outside of the garment and having a generally inverted triangular shape with a generally straight upper edge with a first end and a second end and side edges meeting at a tapered point;

a waistband securer located along said upper edge of said modesty panel near said first and second ends, wherein said waistband securer is adapted to cooperate with a fastener on said waistband; and a belt loop securer located at said first and second ends of said upper edge of said modesty panel.

2. The waistband extender of claim 1 further comprising at least one zipper stop located along a midline of said modesty panel between the tipper edge and the tapered point.

3. The waistband extender of claim 1 wherein said modesty panel is made from a material similar in appearance to the garment.

4. The waistband extender of claim 1 wherein said fastener comprises a button and a buttonhole and said waistband securer comprises a button and a buttonhole.

5. The waistband extender of claim 1 wherein each of said belt loop securers comprises a strip of material and a fastener wherein the strip of material is threaded through a belt loop and fastened.

6. The waistband extender of claim 5 wherein said strip and said modesty panel are made of the same material.

7. The waistband extender of claim 5 wherein said fastener comprises a hook and loop fastener.

8. The waistband extender of claim 1 wherein said zipper stop comprises a button with a loop wherein the loop is threaded through the eye of a zipper tab and then is fastened around said button so that the zipper is secured in place.

9. The waistband extender of claim 8 further comprising a plurality of zipper stops.

10. The waistband extender of claim 1 wherein said upper edge of said modesty panel is elasticized.

11. A detachable waistband extender for removably extending the girth of a waistband in a lower body garment having a releasably fastening waistband with a first end and a second end with a button and buttonhole fastener located at said ends that cooperate to close said waistband and a fly opening extending downwardly from said waistband, said waistband extender comprising:

a modesty panel covering the outside of the garment and having a generally inverted triangular shape with a generally straight elasticized upper edge with a first end and a second end and a first tapered side edge extending downwardly from said first end and a second tapered side edge extending downwardly from said second end wherein said first and said second tapered side edges meet at a tapered point;

a waistband securer located along said upper edge of said modesty panel near said first and second ends, wherein said waistband securer comprises a button and a buttonhole that is adapted to cooperate with said button and buttonhole fastener on said waistband; and a plurality of zipper stops located along a midline of said modesty panel between the upper edge and the tapered point.

12. The waistband extender of claim 11 wherein said modesty panel is made from a material similar in appearance to the garment.

13. The waistband extender of claim 11 wherein each of said zipper stops comprises a button with a loop, wherein the loop is threaded through the eye of a zipper tab and then is fastened around said button so that the zipper is secured in place.

* * * * *

UNITED STATES PATENT AND TRADEMARK OFFICE

CERTIFICATE OF CORRECTION

PATENT NO. : 6,219,848 B1
DATED : April 24, 2001
INVENTOR(S) : Russell

It is certified that error appears in the above-identified patent and that said Letters Patent is hereby corrected as shown below:

Column 5,
Line 7, "tipper" should read -- upper --.

Signed and Sealed this

Twenty-second Day of January, 2002

*Attest:*

*Attesting Officer*

JAMES E. ROGAN
*Director of the United States Patent and Trademark Office*